United States Patent [19]

Gensurowsky

[11] 4,276,663

[45] Jul. 7, 1981

[54] TOILET FACILITY

[76] Inventor: Walter Gensurowsky, 120 W. Granada, Phoenix, Ariz. 85003

[21] Appl. No.: 48,248

[22] Filed: Jun. 13, 1979

Related U.S. Application Data

[63] Continuation-in-part of Ser. No. 776,447, Jun. 29, 1977, abandoned.

[51] Int. Cl.[3] ..... E03D 1/00; B64D 11/02

[52] U.S. Cl. ..... 4/313; 4/316; 4/420.4; 4/443

[58] Field of Search ..... 4/311, 7, 112, 142, 4/263, 313, 316, 420.4, 443

[56] References Cited

U.S. PATENT DOCUMENTS

| | | | |
|---|---|---|---|
| 1,869,036 | 7/1932 | Zink | 4/263 |
| 2,310,658 | 2/1943 | Strite et al. | 4/311 |
| 2,394,091 | 2/1943 | Merwin | 4/112 |
| 2,749,558 | 6/1956 | Lent et al. | 4/112 |
| 2,749,558 | 6/1956 | Lent et al. | 4/112 |
| 2,761,149 | 9/1956 | Kay | 4/112 |
| 2,875,450 | 3/1959 | Umann | 4/7 |
| 3,154,793 | 11/1964 | Congdon | 4/7 |
| 3,247,524 | 4/1966 | Umann | 4/7 |
| 3,964,110 | 6/1976 | Kapit | 4/311 |
| 4,137,579 | 2/1979 | Soler | 4/311 |

*Primary Examiner*—Henry K. Artis

[57] ABSTRACT

A sanitary toilet facility for disposal of human solid and liquid waste having a bowl section with a surface contoured to sealingly engage the body of the user. The bowl is connected to a waste disposal pipe to which is connected a vacuum source. Spray nozzles are arranged within the bowl directed toward the exposed body areas of the user and connected to a source of disinfectant and deodorant. Upon initiation of the cycle, which may be manual or automatic, a vacuum cycle is first initiated to withdraw waste. Thereafter, the spray system is initiated and thereafter a vacuum drying system. In another embodiment of the present invention, the facility has a bowl attached to a flexible waste hose for portability. In still another embodiment, the waste system may be in the form of a urinal for disposal of male liquid waste.

7 Claims, 9 Drawing Figures

TOILET FACILITY

This application is a continuation-in-part of my copending application, Ser. No. 776,447, filed June 29, 1977, entitled "Completely Automated Toilet Facility" and now abandoned.

The present invention relates to a toilet facility and more particularly relates to an automated facility for solid and liquid waste disposal.

Conventional toilet facilities usually include a toilet having a water flush bowl and a seat. These systems are not always completely sanitary and odor free. Further, these conventional systems do not adapt themselves for use in hospitals or other institutions where portability is a requirement. Accordingly, the present invention provides a unique, efficient and completely automated toilet facility for human use. The toilet facility of the present invention incorporates an automatic vacuum system which assists in disposal of waste followed by a cleansing action including dispensing liquid disinfectant and deodorant followed by a vacuum drying action. All of these actions in the cycle are standarized in time and initiated automatically. With this facility of the present invention, the amount of flush or rinse water and tissue required are minimized thus reducing the total flow of waste and waste water to sewage treatment facilities.

Briefly, in a preferred embodiment of the present invention the facility consists of a toilet having a bowl and an annular seat, the seat being configured to provide air-tight sealing contact with the user's body. Sealing is further accomplished by having movable flanges or cover at the front and rear of the seat which engage the body. A vacuum pump is connected to the waste disposal system and the bowl and the operational cycle is initiated upon body contact with the seat. Spray nozzles are arranged about the periphery of the bowl and dispense disinfectant and deodorant followed by a vacuum drying action on a time sequence.

Other embodiments of the present invention include a portable waste disposal toilet facility in which the toilet bowl is connected to the waste disposal system by flexible pipe. A portable housing contains a vacuum pump, disinfectant and deodorant spray units. The portable unit can be made to operate automatically or can be actuated by appropriate switches on the bowl or on the portable unit.

In still another embodiment of the invention, a urinal has a receptacle adapted to sealingly engage the pelvic area of the user. The receptacle can be adjusted to various heights. Vacuum and spray systems are actuated through an appropriately placed foot actuated floor switch.

Other objects and advantages of the present invention will become more readily apparent from the following description, claims and drawings in which:

Figure 1:
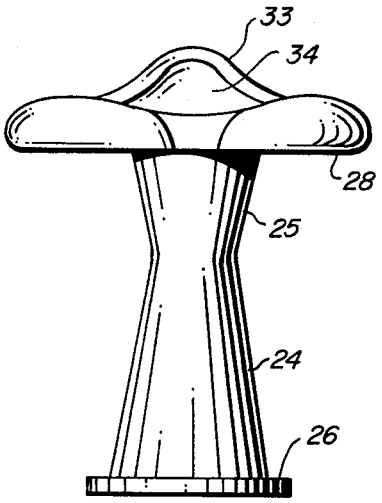
FIG. 1 is a rear view of a toilet fixture to be used with the toilet facility of the present invention.
Figure 2:
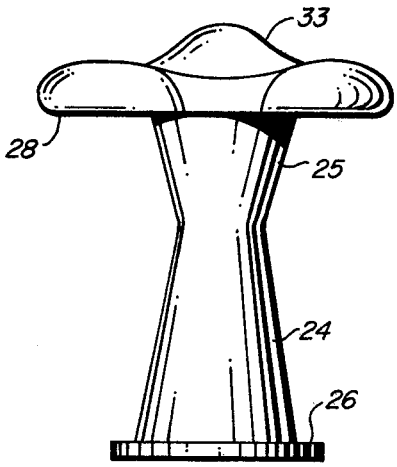
FIG. 2 is a front view of a toilet fixture to be used with the toilet facility of the present invention.
Figure 3:
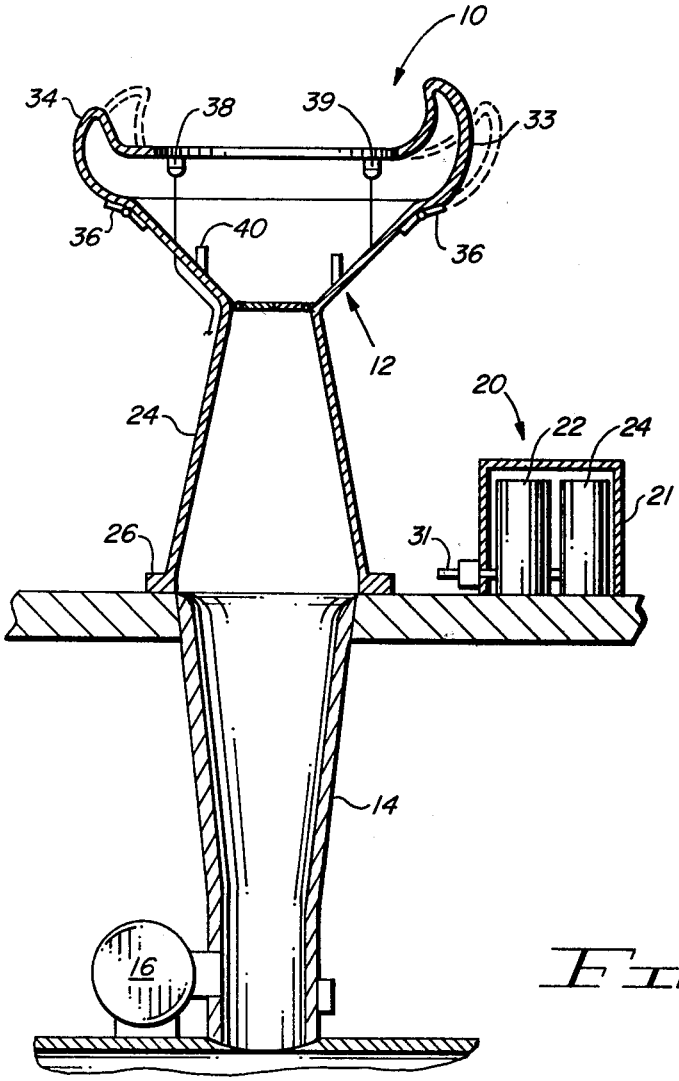
FIG. 3 is a sectional view illustrating the toilet facility of the present invention.

Turning now to the drawings, particularly FIGS. 1 to 4, the solid waste disposal system of the present invention is generally designated by the numeral 10. As seen in FIG. 3, the system 10 includes a toilet fixture 12 connected to a waste discharge pipe 14. A vacuum pump 16, driven by an electric motor is connected to the interior of waste discharge pipe 14 to establish a vacuum therein when actuated. A spray system 20 is contained in housing 21 which encloses deodorizer spray cannister 22 and disinfectant spray cannister 24 along with appropriate electrical controls, not shown.

Figure 4:
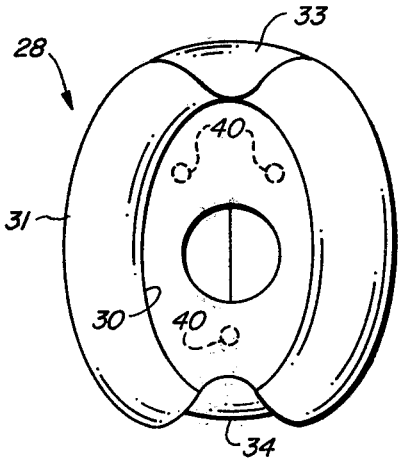
FIG. 4 is a top view of the toilet fixture shown in FIGS. 1 and 2.

The toilet fixture 12 is shown in greater detail in FIGS. 1, 2 and 4 and includes a base section 25 having a lower flange 26 adapted to be secured to the upper end of waste pipe 14 at an appropriate seal as is conventional. The upper end of the base 24 enlarges at bowl section 25 and supports a seat 28. Seat 28 is generally annular defining a central opening 30 communicating with the bowl and waste pipe 14. Seat 28 has opposite side sections 31 having convex upper surfaces as is conventional for comfort and to conform to the body of the user. The front and rear seat 28 carries cups 33 and 34 which are hinged to the bowl at spring hinges 36 as shown in FIG. 3. The cups 33 and 34 may be deflected or moved to the position shown in dotted in FIG. 3. These cups are generally triangular and adapted to sealingly engage the pelvic area and lumbar area of the user. Preferably the entire seat 28 is padded and covered with vinyl or other material having sufficient adhesive quality to assist in providing sealing engagement with the body of the user.

Electric switches 38 and 39 are connected respectively to vacuum pump motor 16 and to spray system 20. Spray cannisters 22 and 24 are connected to spray nozzles 40 arranged about the inside of the bowl as shown in FIGS. 3 and 4 and disposed to apply a spray on the user. The weight of the body of the user on the seat actuates an electrical switch, now shown, which actuates vacuum motor 16 and begins the entire cycle of operation. The suction applied assists in withdrawing waste from the body and from the bowl to the waste pipe 14 and to a disposal location. The spray nozzles 40 located within the bowl are connected to the spray system 20 by tubes 31 and automatically spray a disinfectant and a deodorant into and around the exposed body regions after the vacuum action ceases. After spraying, an automatic vacuum drying action is imparted by vacuum pump 16. The appropriate timers controlling the duration of the various cycles and other electrical components which are conventional have been omitted for clarity. Instead of using a vacuum pump 16, a fan can be placed in the bowl to promote drying. The operation of the facility is initiated automatically and minimizes or completely eliminates the requirement for flush water reducing the waste water load on treatment plants. Further, the system is sanitary and substantially eliminates odors and the need for tissue.

The bowl and base can be fabricated in conventional manner, of stainless steel or a ceramic coated cast iron material. The toilet seat 30 as pointed out above, can be covered with a padding material and a vinyl or a cloth adhesive plastic and is body contoured so as to fit tightly against the buttocks and other regions of the user.

Figure 5:
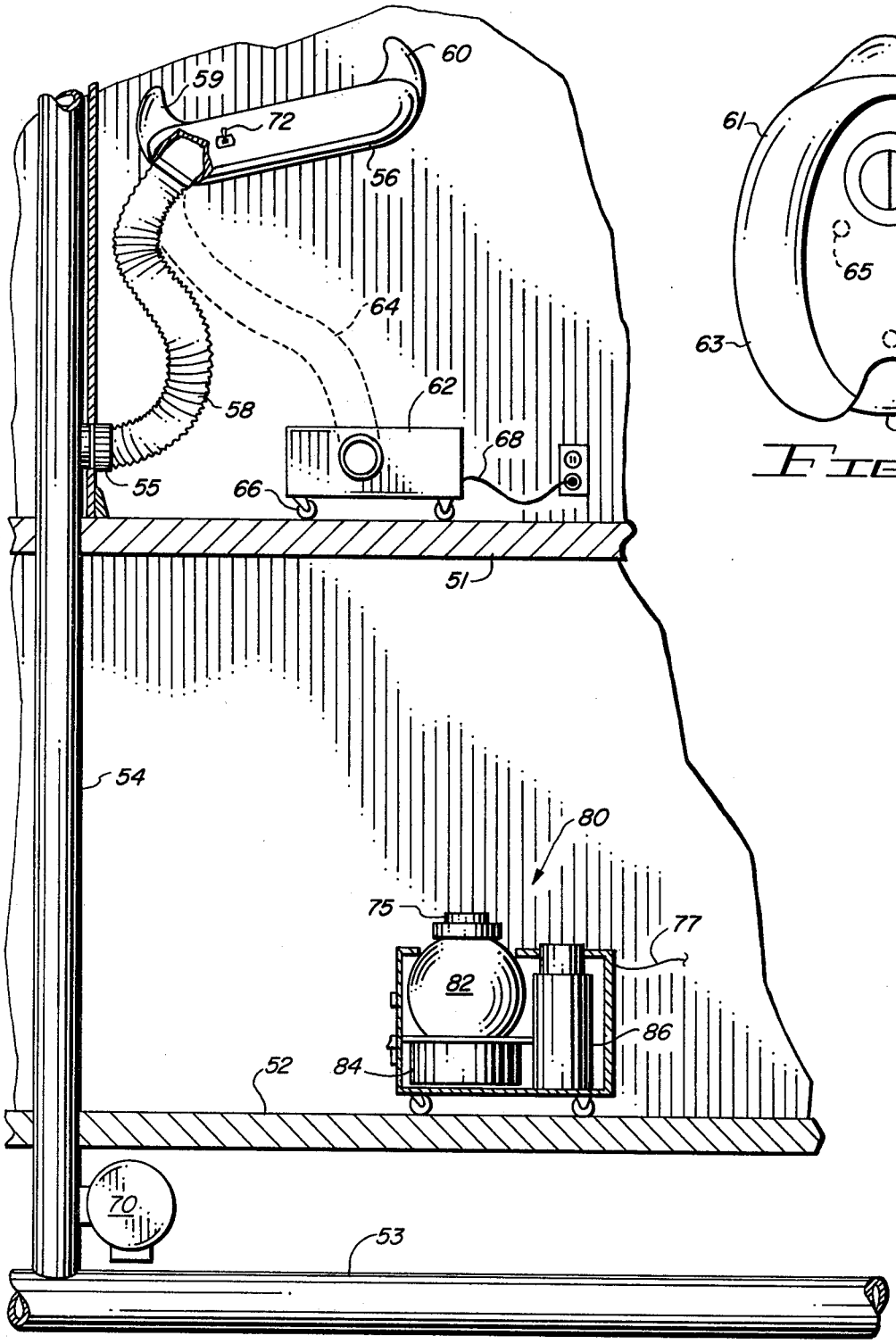
FIG. 5 is a view partly in section illustrating a portable waste disposal facility according to the present invention.
Figure 6:
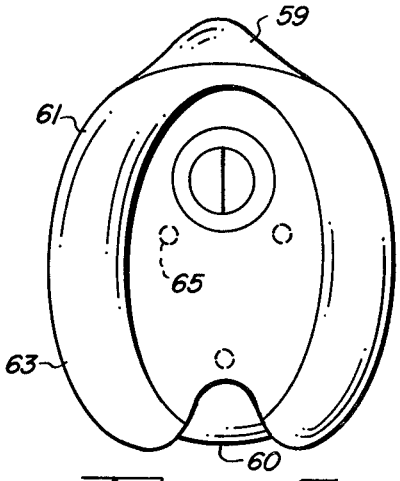
FIG. 6 is a top view of the portable toilet fixture shown in FIG. 5.

An alternate embodiment of the present invention is shown in FIGS. 5 and 6. In these figures the portable system is generally designated by the numeral 50 and shown installed in a multiple level building having upper floor 51 and lower floor 52. A conventional sewage disposal pipe 53 is connected to vertical disposal pipe 54. Pipe 54 is connected at detachable coupling 55 to portable bowl 56 by means of flexible waste hose 58. The bowl 56 may be fabricated from any suitable material such as plastic, metal or fiberglass. Bowl 56 supports a seat 61 configured as have been described with reference to previous figures having an annular upper surface 63 contoured to fit tightly against the body of the user and including front and rear covers 59 and 60 which are hingedly secured to the seat to engage the body of the user.

A portable housing 62 contains spray cannisters of deodorant disinfectant which are connected to bowl 56 by flexible tubing 64 to be discharged at spray nozzles 65 within the interior bowl directed toward the body of the user. Housing 62 is self-contained and mounted on wheels 66 having its own electrical supply connectable to a source of power by line 68.

Vacuum pump 70 is connected to vertical waste pipe 54 and upon actuation system by means of switch 72, the cycle of suction, spraying of deodorant disinfectant and vacuum drying is initiated. The flexible hose 58 permits the unit to be transported to a bed or chair for use by an invalid person. When not in use, hose 58 can be disconnected and the unit sanitized and moved to another location.

In the event it is desirable to make the facility fully self-contained and independent of any centralized waste treatment system 53, a portable waste disposal unit 80 may be connected to waste hose 58 at connection 75. Waste disposal unit 80 includes a waste receptacle 82 preferably lined with a plastic bag or container for convenience of ultimate disposal. The vacuum motor 84 connectable to a power source at line 77, serves to draw the waste materials to the receptacle 82. Spray cannisters 86 contain disinfectant and deodorant and may also be incorporated in the portable unit 80. Unit 80 provides an entirely self-contained system particularly adapted for use in hospitals and other institutions.

Figure 7:
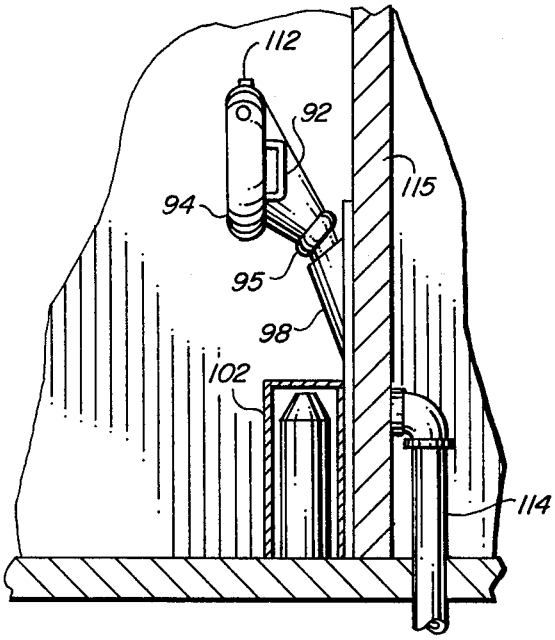
FIG. 7 is a side view partly in section illustrating a liquid waste disposal system according to the present invention.
Figure 8:
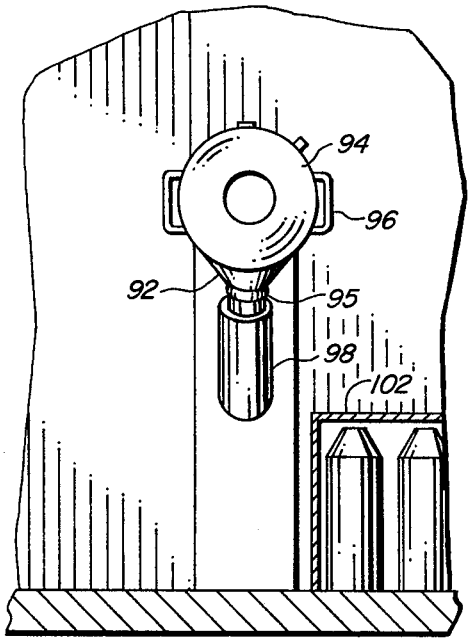
FIG. 8 is a front view of the system shown in FIG. 7.
Figure 9:
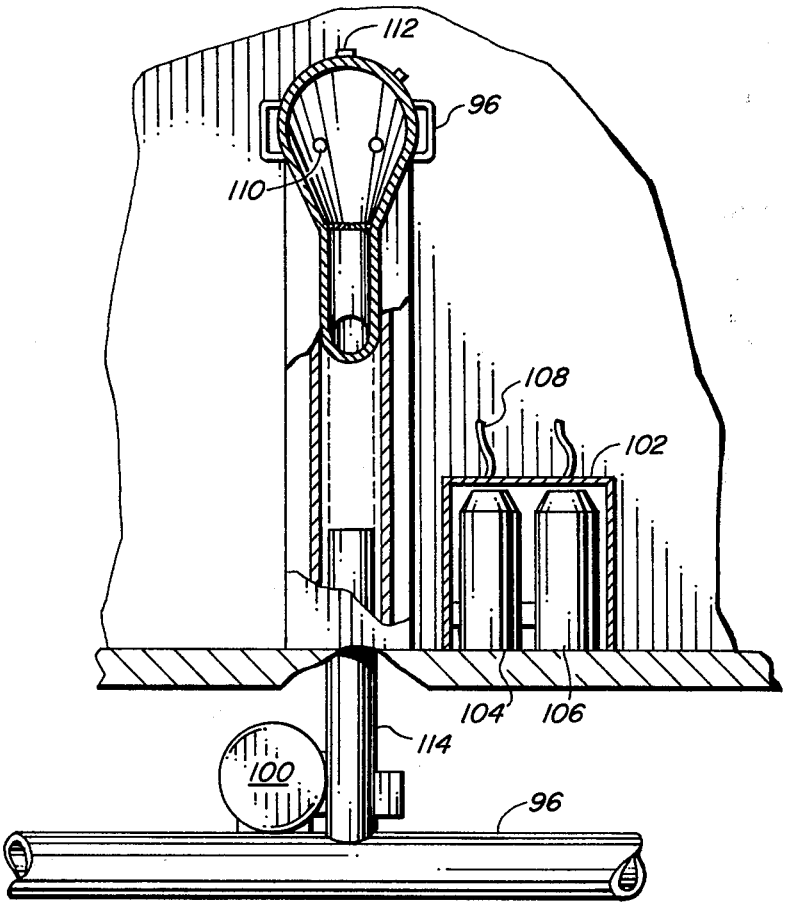
FIG. 9 is a front view partly in section showing the liquid waste disposal system of FIGS. 7 and 8.

Another embodiment of the present invention is shown in FIGS. 7 to 9 and is generally designated by the numeral 90. Embodiment 90 is a liquid waste or disposal system of the urinal type and involves a generally funnel or conical shaped receptacle 92 opening at annular rim 94. Rim 94 is padded and covered with a partially inflated cloth or adhesive plastic and is body contoured so as to tightly fit the lower abdomen, front part of thighs and groin region of the user. Receptacle 92 is secured to pipe 98 by flexible joint 95. Pipe 98 is telescopic and connects to waste disposal pipe 114. By use of handles 96, the user can increase or decrease the height of the receptacle as required by telescopically increasing or decreasing the length of pipe section 98. Similarly, the entire receptacle 92 can be pivoted about connection 95 to place the rim 94 in contact with the user.

Vacuum pump 100 applies appropriate vacuum to waste disposal pipe 114. A spray 106 which is connected by tubing 108 to receptacle 92 is adapted to discharge at nozzles 110 at the interior of receptacle 92. Electric switch 112 on the receptacle initiates the entire waste cycle automatically starting vacuum pump 100 and releasing deodorant spray 104 and 106. Preferably the spray system housing 102 is located adjacent the wall 115 of the facility. As has been described before, the operational cycle is automatically controlled by an electrical timer circuit and appropriate valves, not shown.

Thus it will be seen the foregoing provides a completely automated toilet facility which provides for disposal of human solid and liquid waste. The facility is sanitary, odorless, and may be automatically or semi-automatically operated through the various operational cycles. The source of energy is electricity which can be conventional generated electricity or batteries can be used. The facility of the present invention has application to homes, institutions and other locations where humans congregate, rest, work or live. The advantage of the present system is that is provides for the hygienic disposal of waste, eliminates contamination of body, clothing and surrounding areas. The system of the present invention is particularly well adapted where tissue material or water are scarce or not available.

I claim:

1. A toilet facility for disposal of solid and liquid human waste comprising:

(a) a bowl adapted to be connected to a waste disposal system, said bowl having a receptacle for the reception of waste and having a rim contoured to sealingly engage a portion of the body of the user;

(b) vacuum means for inducing a vacuum within said bowl;

(c) a spray system including a container for a spray medium, spray nozzle means located within said bowl positioned to direct a spray on a portion of the body of the user, conduit means connected said nozzle means and said spray container; and (d) control means for controlling said vacuum means and said spray system in a predetermined cycle of operation, said control means being associated with said bowl and being actuable by the body weight of the user.

2. The toilet facility of claim 1 wherein said control means includes switch means cooperable with said rim, said switch means being pressure actuated whereby said cycle is initiated by the weight of the user against said rim.

3. The toilet facility of claim 1 wherein said rim comprises a generally annular shaped seat defining a central opening and including pivotally mounted generally cup-shaped members at the front and rear of said seat, said cup members being biased whereby the rim portion can be placed in sealing engagement with the user when the user is in a generally sitting position.

4. The toilet facility of claim 3 wherein said seat has a generally adhesive contoured covering.

5. The facility of claim 1 wherein said waste disposal system includes a flexible pipe whereby said bowl is portable and can be moved to a pre-selected use location.

6. The toilet facility of claim 1 wherein the rim of said receptacle is secured in a generally vertical position wherein said receptacle is vertically displaceable to a pre-selected position for disposal primarily of male liquid waste.

7. The toilet facility of claim 1 wherein said cycle of operation comprises initial vacuum followed by disinfectant and deodorant spray and vacuum drying action for a predetermined period of time.

* * * * *